United States Patent [19]

Varney et al.

[11] Patent Number: 4,722,322

[45] Date of Patent: Feb. 2, 1988

[54] HIGH EFFICIENCY COMBUSTION HEATER

[76] Inventors: Frederick M. Varney, Rte. 9, Box 89FV, Santa Fe, N. Mex. 87505; J. Arnold Varney, 7326 Ogelsby Ave., Los Angeles, Calif. 90045

[21] Appl. No.: 57,711

[22] Filed: Jun. 1, 1987

Related U.S. Application Data

[62] Division of Ser. No. 841,940, Mar. 20, 1986, abandoned.

[51] Int. Cl.[4] ..... A47G 23/04

[52] U.S. Cl. ..... 126/261; 126/262; 126/9 R; 126/15 R

[58] Field of Search ..... 126/15 R, 9 R, 9 B, 126/2, 77, 25 B, 261, 262

[56] References Cited

U.S. PATENT DOCUMENTS 2,502,434 4/1950 Creitz ..... 126/262

4,368,727 1/1983 Higgins et al. ..... 126/9 R

*Primary Examiner*—Carroll B. Dority, Jr.

*Attorney, Agent, or Firm*—William H. Pavitt; Natan Epstein

[57] ABSTRACT

A furnace or furnace-and-pot heating system comprises an inner shell, an outer shell surrounding the inner shell to form a duct between the two shells for preheating combustion air flowing down the duct to enter a combustion chamber within the inner shell. A container or pot for heating material such as water or foodstuffs may be supported inside the inner shell and above a combustion zone, such pot to be of diameter to form with the inner shell an annular flue for escape of combustion products. Draft control means are provided to regulate the amount of combustion air entering the combustion chamber.

17 Claims, 18 Drawing Figures

Fig. 1
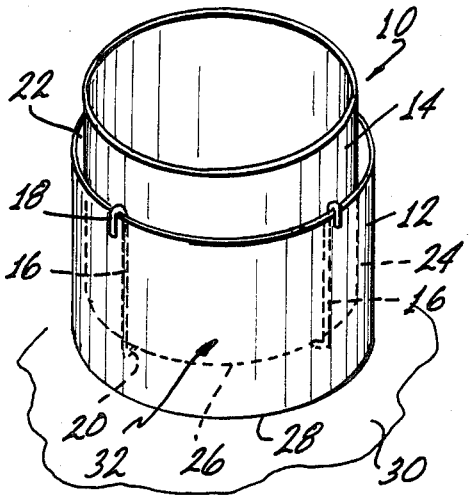
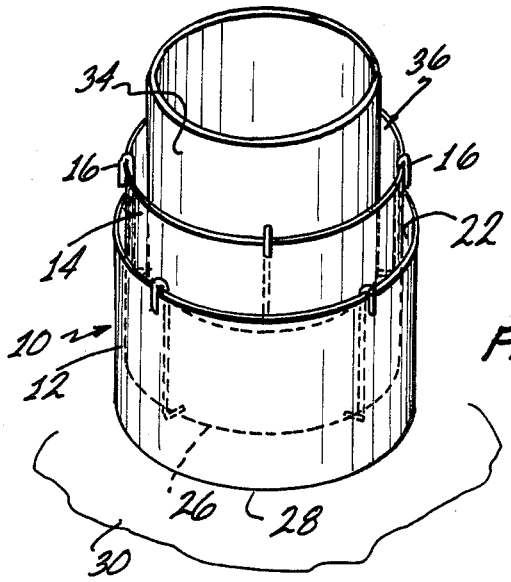
Fig. 2
Fig. 4
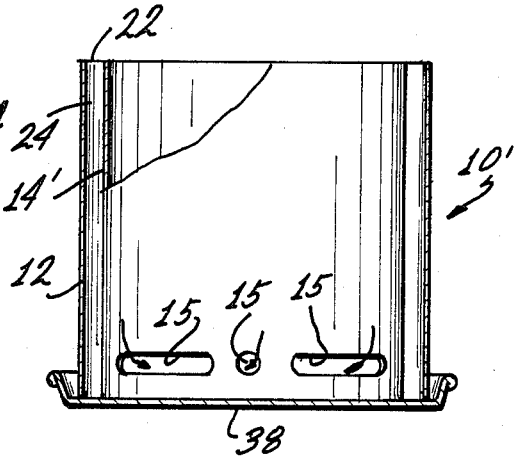
Fig. 3
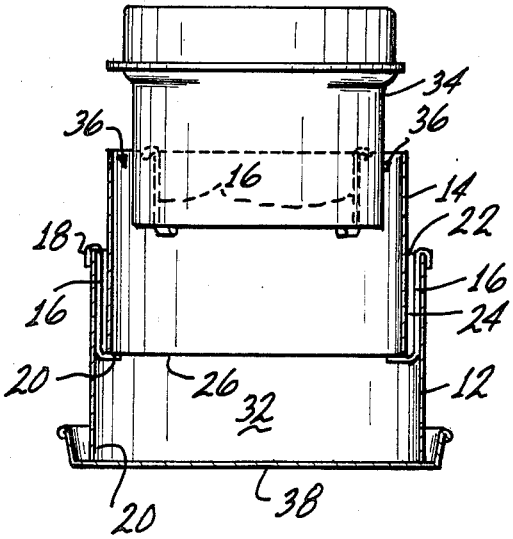
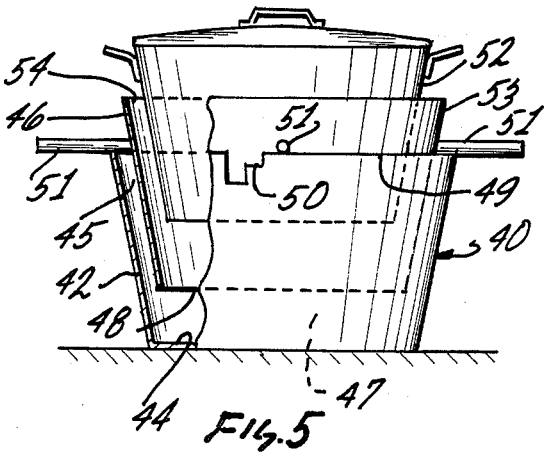
Fig. 5

Fig. 18
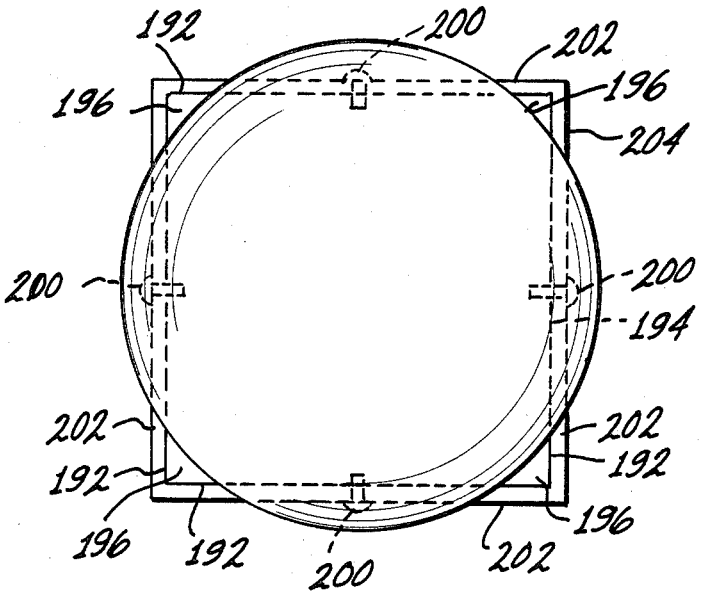
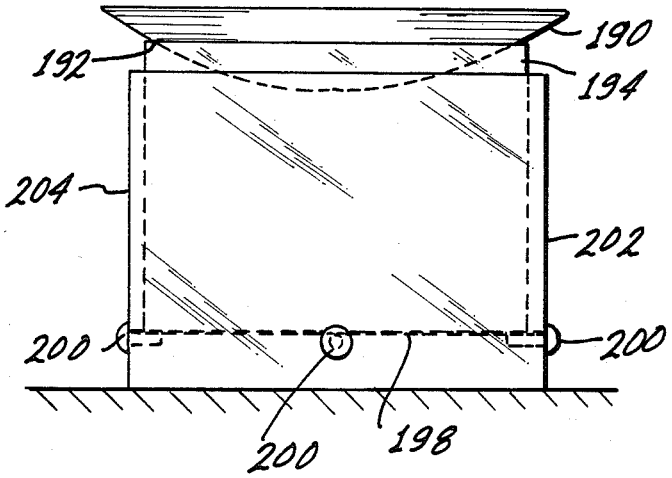
Fig. 17

HIGH EFFICIENCY COMBUSTION HEATER

This application is a file wrapper divisional of application Ser. No. 841,940 filed Mar. 20, 1986 and now abandoned.

BACKGROUND OF THE INVENTION

1. Field of the Invention

The invention relates generally to combustion heaters and is more specifically directed to portable stoves or furnaces which may be employed with or without a pot for heating and especially for cooking foodstuffs and for boiling of water with combustible materials under relatively primitive conditions.

2. Description of the Prior Art

Field stoves and domestic heaters for cooking and heating water have been devised in considerable variety ever since cast iron and especially sheet iron became widely available. Benjamin Franklin made the first great advances in stove and heater design around 1740. Count Rumford (Benjamin Thompson) during the decades around 1800 devised a variety of stoves and pot-and-fire units described and depicted in the book entitled FIRE by John W. Lyons (Scientific American Books, Inc., 1985), a broad and scientific overview of the topic by the Director of the National Engineering Laboratory of the National Bureau of Standards and himself a world authority in the technology of fire.

It is clear that Count Rumford gained profound insights through scientific experiments and understood, along with Lavoisier, George Stahl and Robert Boyle, apparently for the first time in history the true nature of heat and some of the fundamental properties of fire as a physical/chemical phenomenon as well as the heat transfer mechanisms of conduction, convection and radiation. Applying this wealth of new knowledge, Count Rumford devised a wide variety of means for improving control of fire and of enhancing heat transfer from a confined fire, as in a furnace or stove, to the contents of a vessel as for heating water or cooking in a pot.

Count Rumford's insights are reflected in patents issued since his time such as U.S. Pat. Nos. 118,095 for "Improvement in Portable Furnaces" (1871); 320,799 and 355,696, both granted in 1887 for "Portable Furnace"; 936,482 for a "Portable Stove" issued in 1909; and 2,290,802 issued in 1942 for a "Cooking Stove." None of these prior art devices integrates in one system all primary functions and properties now known to be requisite to realization of high efficiency and high rate of heating in a practical and simple combination of elements.

BROAD OBJECTIVES OF INVENTION

The present invention provides not only exceptionally high efficiency and speed of heating in a field-type furnace or furnace-and-pot combination but provides for controlled combustion of fuels of widely varying burning characteristics, including conventional firewood cut to appropriate sizes, woody cellulose-rich materials of a chunky nature such as dead weed stumps; and, by way of contrast, combustible materials of very large surface area-to-volume ratio, like twigs, fronds and paper; which are not normally considered suitable for cooking fires after initial use as kindling. Briquetted fuels, coal and charcoal can likewise serve well, as can synthetic fuels of various types. It is also notable that for long sustained fires, continuous feeding of fuelwood into the combustion chamber can be accomplished conveniently by inserting long sticks down the flue annulus, the lower ends of such sticks then burning vigorously in the combustion chamber of the novel stove. The significance of this feature of our inventive structure lies in the fact that it is now always easy to reduce fuelwood to lengths which will lie transversely in a confined combustion zone. Such can be the case especially in the absence of a tool, such as an axe or saw, for cutting wood. Breaking of wood into short pieces can represent a serious difficulty in the case of non-brittle species. An object of our invention, then, is to overcome this problem in the use of field stoves of prior art design by providing for insertion of fuel without disturbing either the heating vessel or means for control of draft.

The inventive heating systems described and depicted herewith also, as a broad object, comprise components of extraordinary ease and low cost of fabrication, even under relatively primitive circumstances as found in many areas of the word where cooking with fuelwood is the general practice.

A further object of our inventive field furnace is to achieve a configuration and structure which lends itself to adaptation to existing cooking vessels of widely varying diameters, although ideally a pot specifically related in proportions and dimensionally to the furnace proper would be employed in a preferred embodiment. This is due to the fact that our furnace-and-pot heating system employs the well known technique of immersing the cooking or water heating pot in flames and hot gases rising from the fire so as to maximize area through which heat transfer may take place through bottom and side walls of the container. Thus, the pot in the present invention is supported largely within a flue component of the system. This technique also minimizes heat loss from the pot to the environment, epecially wasteful of fuel when the pot is exposed to a breeze or wind.

SUMMARY OF THE INVENTION

The primary and requisite functions to high efficiency and rate of heating in a furnace and, especially, in a furnace-and-heating-vessel combination have only in relatively recent years been fully understood through research in the chemistry and physics of combustion as well as the physics of heat transfer. These factors provide the technical foundation underlying performance and structural improvements over the prior art represented in the present invention system. The technology involved is discussed as follows, first with respect to combustion efficiency and then with respect to heat transfer from flames and flue gasses into a pot containing material to be heated.

Regarding combustion efficiency, the highest practical or manageable temperatures in the combustion process should be developed, whereby combustion will be both rapid and complete compared to burning the same fuel at lower temperatures. Visible smoke, which comprises unburned carbon particles, should be minimized, of course. The present invention achieves high temperature combustion through the following measures and related structures:

1. Combustion air is preheated, that is, heated prior to entering the combustion chamber or zone, by counterflow heat transfer from flue gasses and by contact with upper walls of the combustion chamber which are preferably sheet metal and therefore rapidly become very hot--observably red hot at times. Counterflow heat transfer is accomplished in a preferred embodiment of our invention by surrounding a cylindrical flue with a cylindrical shell spaced apart from the flue cylinder so as to form an annulus therebetween. Combustion air is drawn down such annulus to replace air leaving the combustion chamber under impetus of convection up the flue. Such escaping air is, of course, very hot and intermixed with combustion products, including at times flames, rising up the flue. Hence the presence in our configuration of a counterflow conductive heat exchange structure. Such heat exchangers are known for their high thermodynamic efficiency.

2. Combustion air flows forcefully into the combustion chamber, induced by convection as indicated above, providing a bellows or blower effect to fan the fire to a high rate of burning.

3. Combustion air enters the combustion chamber in the lower portion thereof and is directed downward as it leaves the intake orifice means to enter the fuel mass from the lower periphery thereof. Primary need for oxygen to support combustion is at the root of a flame where combustion is initiated. Air mixing with flames above this root portion has the adverse effect of cooling the flame and combustion products. Our novel combustion chamber and air intake configuration produces a highly desirable pattern of combustion air flow into the base portion of the fuel mass and shields the mature flames above the fuel charge from air flow which would otherwise tend to comingle with and thereby cool the flames and combustion products.

4. Combustion air flows into the combustion zone from all sides simultaneously due to the annular configuration of the orifice through which such combustion air enters the fire box or combustion chamber in preferred forms of our invention. Thus no portion of the burning fuel charge is starved for air (oxygen, that is) and consequently the entire fuel charge, after becoming well kindled, burns briskly and hotly. Distribution of combustion air is uniform and delivered to the fuel mass for efficient mixing with the combustible gasses driven from the fuel as a result of heating and pyrolysis.

5. Hot walls of the combustion chamber radiate heat back to the fuel charge whereby the fuel itself is elevated in temperature with consequent acceleration of outgassing of the fuel. As is well known in the technology of combustion of solid fuels, it is volatile substances issuing from the fuel on being heated for ignition that initially combines with oxygen to burn. Subsequently, in the case of wood, combustible gasses resulting from pyrolysis are given off and burn. Pyrolysis is the process of thermal decomposition of cellulose and lignin of which wood is composed. The entire outgassing and therefore burning process is accelerated by radiant heating of the fuel charge by "black body" radiation from the hot walls of the combustion chamber. Researchers have seen increases in fire intensity, as measured by burning rate, by as much as a factor of 2 on placing a given fire in an enclosure (reported by John W. Lyons in his above-cited treatise on Fire). Geometry of the combustion chamber is therefore important. The present invention reflects this fact in providing a cylindrical wall closely surrounding the burning fuel charge, whereby radiant heat from such wall is, in effect, focussed back on the fuel charge with consequent highly effective heating of such fuel charge to accelerate outgassing and pyrolysis.

Such focussed thermal radiation may be further enhanced by insulating the wall of the combustion chamber to minimize loss of heat to the environment, whereby such wall will rise in temperature and therefore increase radiation therefrom back to the fuel charge. In a preferred embodiment of our invention, a measure of such insulation is provided by surrounding the combustion chamber with a downward projection of the outer preheat shell to the supporting surface on which the combustion chamber shell and outer shell rest. Thus, a shroud around the combustion chamber is provided to shield the wall of such chamber from conductive heat loss to the environment, especially important in windy conditions and to minimize radiant heat loss by reflecting such radiant heat back to the outside surface of the of the combustion wall. In some embodiments of the invention, it may be found desirable to insulate the combustion chamber with refractory insulating material to maximize retention of heat within the combustion chamber. In so raising the temperature of the combustion chamber wall, it has been found desirable to employ relatively non-oxidizing and high melting-point material such as corrosion resistant steel sheet for construction thereof. A separate and replaceable liner for the combustion chamber is provided in one preferred form of our invention adapted especially to daily use in family cooking and water heating where the corroding effect of sustained elevated temperatures must be countered for economic reasons. Such a liner could, in less portable embodiments of the invention, be made of a refractory non-metallic substance or of cast iron.

Radiant heating of the fuel charge is further enhanced in a preferred embodiment of the invention by provision of a metallic tray or pan on which the combustion chamber shell or wall rests. Such a pan heats rapidly during onset of combustion and remains very hot throughout the burning process with a given charge of fuel. It therefore radiates upward into the fuel charge. The effect can be enhanced by providing a dead air space or refractory insulating material beneath the pan to serve an insulating function.

6. By way of further maximizing flame and flue gas temperatures, combustion air should be permitted to enter the combustion chamber only in sufficient quantity to suppot combustion and no more, preferably. The reason for such restriction of combustion air intake lies in the fact that any air in excess of that required for combustion of a given fuel charge of certain burning characteristics has the undesirable effect of cooling the flames and combustion products. Since air is about 80% nitrogen, which is noninflammable, excess air acts as a coolant. Preferred embodiments of the present invention provide sensitive draft control means whereby the operator can, by observing the flame qualities and smoke emissions, regulate the rate of flow of combustion air to a nicety. A bright yellow flame and of course, minimum smoke are criteria of good combustion. As previously noted, smoke comprises unburned carbon particles carried out the flue by the flue gasses (invisible) and represent a net loss of chemical energy from the combustion zone. Flame quality can be observed by looking down the flue annulus between the flue cylinder and the pot supported within the flue cylinder. The volume of flue gasses generated during full combustion of a normal charge of fuel requires a flue annulus of width quite sufficient to allow observation of flame quality in the combustion zone beneath the pot.

A further and important function of sensitive draft control means is that of suppressing rate of combustion of highly combustible fuels, such as twigs and dry palm fronds, for instance, which are characterized by high surface area-to-volume ratio. Such fuels, if permitted, burn so actively as to be quite impractical as cooking or water heating fuels. By restricting combustion air supply to a closed combustion zone, rate of burning of such fuels can be suppressed sufficiently to render them entirely useful. Where more normal fuelwood is in short supply, this feature of our furnace-and-pot heating system can be of crucial importance. A prolonged heating period may be realized simply by dropping twigs or other such finely divided fuel pieces down the flue annulus into the combustion chamber.

A noteworthy observation regarding importance of achieving high temperatures of combustion in the present invention, aside from combustion efficiency as such, is that once combustion is well under way and high temperature achieved, green (freshly cut) wood can be introduced into the combustion zone and burned successfully. This is due to the fact that at such high combustion temperatures moisture in the wood evaporates rapidly, albeit absorbing thermal energy in the process, to allow pyrolysis to set in and combustible gasses to be given off, thereby sustaining combustion.

As noted heretofore, a broad reason to seek high combustion temperatures is to enhance combustion efficiency. A second basic objective in achieving high temperatures both in the flames and in flue gasses is to enhance rate and effeciency of heat transfer to the contents of a pot exposed to such heat. The physics of heat transfer is involved. Heat transfer takes place through one or more of the processes of conduction, radiation and convection. All three of these processes are involved in the functioning of the present high-efficiency combustion heater system. Novel means to enhance heat transfer are incorporated, as described and depicted hereinafter.

Initially, it may be noted that heat transfer by conduction varies directly as (that is, the first power of) the temperature differential between two bodies in contact, in this case the flames and flue gasses, representing a high temperature "body", and the pot with its contents representing a cooler body or heat sink. Clearly, the hotter the fire and flue gasses in contact with the pot, the higher the rate of transfer of heat by conduction.

Secondly, heat transfer by radiation between two bodies, each acting as a true "black body" (theoretically perfect radiator and/or absorber of radiant thermal energy) varies as a function of the difference between the absolute (Kelvin) temperatures of each body, each temperature raised to the fourth (4th) power. The flames, red hot embers and the hot flue all, to varying degree, radiate thermal energy; and the pot, commonly and desirably (from the heat transfer viewpoint) quite sooty and flat black is an efficient "black body" absorber. It follows that maximum utilization of radiant heat transfer should be an objective of high importance and that structures and means to enhance this process in a furnace-and-pot heating system are of the essence. The presence inventive combination includes novel means to enhance radiant heat transfer. These means include shrouding the flue so as to minimize heat loss to the environment therefrom, thereby raising the temperature of the flue as well as insulating the outer preheat shell so as to enhance radiant heat transfer from the flue to a pot supported within the flue. Unitary means both for preheating combustion air and for elevating the temperature of the flue is a feature of the present inventive combination.

The third process of heat transfer noted above as involved in the present invention is that of convection. Whereas convection is involved in essentially all combustion processes, our furnace-and-pot heating system employs convective flow in a restricted duct comprising, in a preferred embodiment of the invention, the annulus between a cylindrical pot and a cylindrical shell. Thus, a flue of proportions designed to accelerate flow of hot combustion products in the flue is provided. Importance of this feature lies in the fact that induced relatively high velocity flow of flue gasses has the beneficial effect of scrubbing the boundary layer of relatively cool molecules immediately adjacent the side surfaces of the pot and the flue shell away from such surfaces to allow relatively hot molecules to circulate in close proximity to such surfaces and thereby allow thermal energy contained in such hot molecules to transfer both directly and indirectly to the cooler walls of the pot and flue by conduction. Convection is thereby employed in our heating system to enhance conductive heat transfer from flue gasses to pot and to inflowing combustion air.

A number of objectives of the present invention, aside from high efficiency and rapid heating capability, include structures which permit compact storage for improved portability and for dense-pack shipment, to overcome the bulk problem in transportation of stoves.

A further object of the invention is to provide a field-type furnace-and-pot heating system which can function with little or no significant degradation of performance when used under windy conditions as often encountered in the desert, in alpine areas and along the seashore.

A further object of the invention is to provide a furnace of performance characteristics as set forth herein which can readily be adapted to pots in a range of diameters while employing a single set of components.

A further object of the invention is to provide a combustion heating system of the type described which lends itself to extremely light construction while yet providing adequate durability for mountaineering and similarly rough conditions.

A further object of the invention is to provide a compact furnace-and-pot heating system of such high efficiency that a single initial fuel charge will suffice to bring a full pot of water, for instance, to a boil or, with suitable damping, to allow cooking for an extended period.

BRIEF DESCRIPTION OF THE DRAWINGS

FIG. 1 is an isometric view taken from above a combustion furnace constructed according to the present invention.

FIG. 2 is a similar isometric view of a combustion furnace-and-pot heating system constructed according to the present invention.

FIG. 3 is a side elevation view partially in section of a furnace-and-pot heating system constructed according to the present invention and with primary components dimensioned to be stowable inside the pot.

FIG. 4 is a side elevation view, partially in section, of a furnace constructed according to the invention and incorporating apertures in a unitary flue shell and combustion chamber wall for combustion air to enter the combustion zone within the furnace.

FIG. 5 is a side elevation, partially in section, of a furnace-and-pot heater constructed according to the invention in which the primary members are in the form of frustums of cones.

FIG. 17 is a side elevation view of a stove contructed according to the invention in an embodiment adapted to use in conjunction with a Chinese wok or shallow spherical section cooking pan.

FIG. 18 is a plan view of the embodiment of FIG. 17 showing the square planform of both inner and outer shells.

DETAILED DESCRIPTION OF THE PREFERRED EMBODIMENTS

Figure 6:
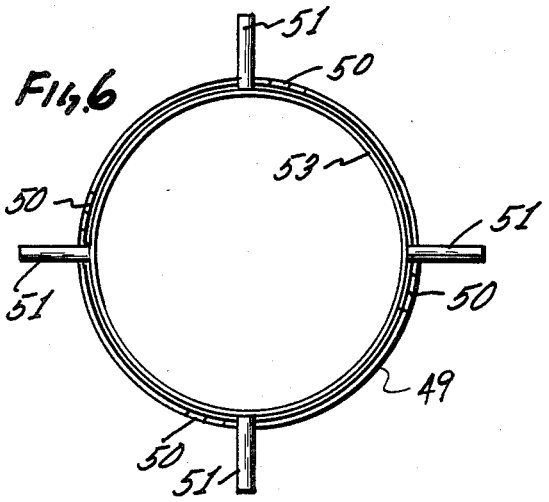
FIG. 6 is a top plan view of the arrangement of FIG. 5 with the pot removed for clarity.

With reference to the drawings, FIG. 1 shows a high efficiency stove in a basic embodiment of the present invention consisting of a tubular, cylindrical outer shell element 12 concentrically surrounding an inner tubular cylindrical shell element 14. In this basic embodiment, both inner and outer shells 12 and 14 are opened at both ends and merely terminate in upper and lower rims. The inner shell 14 is suspended from the upper rim of the outer shell 12 by means of wire formed hanger 16, each of which has an upper hooked end 18 which hooks onto the upper rim of the outer shell 12 and a lower end 20 bent to extend radially inwardly from the outer shell 12, several such hangers 16 spaced circumferentially about the outer shell 12 providing a stable support for the lower rim of the inner shell 14. The outer shell 12 is of somewhat greater diameter than the inner shell 14 so as to define between the two shells an annular intake opening 22 and intake flue 24 extending from the upper rim of the outer shell 12 to the lower rim of the inner shell 14.

The inner shell 14 is suspended from the outer shell 12 such that its lower rim 26 is raised relative to the lower rim 28 of the outer shell 12. Thus, an annular opening exists communicating the intake flue 24 with the interior of the inner shell 14. In the use, the stove arrangement 10 is placed on an underlying supporting surface 30 such as a ground surface which closes the lower end of the outer shell 12. The lower rim 26 of the inner shell however remains spaced from the underlying surface 30. The area on the ground surface 30 underlying the bottom opening of the inner shell 14 constitutes a combustion zone 32. the combustion zone 32 is circumferentially opened to the air intake flue 24 as best seen in the elevational section of FIG. 3. A charge of fuel such as wood is placed on the underlying surface 30 and underneath the opening of the inner shell 14, i.e. within the combustion zone 32.

A pot or container 34 may be suspended or otherwise supported so as to partially extend into the upper opening of the inner shell 14 as shown in FIGS. 2 and 3. The container 34 may be hung from the upper rim of the inner shell 14 by means of wire hangers 16 similar to those used to hang the inner shell 14 from the upper rim of the outer shell 12 as explained in connection with FIG. 1. The container 34 desirably is cylindrical and of an outer diameter sufficiently undersized in relation to the inner diameter of the inner shell 14 so as to define therewith an annular exhaust flue 36.

In operation, when a fuel charge is placed and ignited within the combustion zone 32, the hot gases resulting from combustion of the fuel charge rise into the inner shell 14 and are discharged to the atmosphere through the exhaust flue 36 surrounding the container 34. Heat is transferred from the gases to both the container 34, thus heating its contents, as well as to the inner shell 14. The inner shell 14 is made of heat conductive material such as a metal selected to be substantially impervious to the relatively high temperatures of the stove fire. The hot gases generated in the combustion zone rise upwardly and thus create a partial vacuum in the combustion zone which has the effect of drawing cool atmospheric air into the intake opening 22 and downwardly through the intake flue 24 surrounding the inner shell 14. The cool intake air is forced thus into relatively close proximity to the hot inner shell 14 by the relatively narrow radial gap between the inner and outer shells. Heat from the inner shell 14 is thus transferred to the intake air, preheating the intake air prior to its entry into the combustion zone 32. The preheating of the intake air results in more efficient and complete combustion of the fuel in the combustion zone 32, for reasons earlier stated in this specification, as well as capturing a portion of the heat otherwise lost in escaping gases.

In the basic embodiment shown in FIGS. 1 and 2, the outer shell 12 is opened at its lower end and is closed in cooperation with an underlying, supporting surface, which may conveniently be a ground surface.

In other embodiments of this invention, such as shown in FIGS. 3 and 4 a bottom pan 38 is provided and the lower rim of the outer shell 12 is set on the pan 38, thus closing the bottom end of the outer shell and also providing a fire proof surface on which the fuel charge may be burned.

The embodiment shown in FIG. 4 differs from those previously described in that the inner shell 14' is not supported in elevated relationship to the outer shell 12, but instead its lower end rests on the underlying, supporting surface in this case an underlying pan 38. The inner shell 14' is apertured by a series of openings 15 which are desirably spaced about the entire circumference of the inner shell near the lower end or lower rim of the inner shell 14', to admit intake air into the combustion zone 32 which in this case is surrounded and enclosed by the lower portion of the inner shell 14'. Intake air is admitted to the combustion zone by the openings 15 at or near the lower end of the inner shell 14'. The operation of the FIG. 4 embodiment is otherwise similar to those previously described and incorporates an intake opening 22 and intake flue 24 defined between the inner and outer shells 12, 14' respectively. A cooking vessel such as 34 in FIGS. 2 and 3 may be similarly suspended from the upper rim of the inner shell 14' in FIG. 4.

Turning to FIG. 5, a still further embodiment 40 of the present invention comprises an outer shell 42 having a closed bottom 44 and an inner shell 46 having an opened bottom and terminating in a lower rim 48. Both inner and outer shells 42, 46 are frustoconical elements which increase in diameter in an upward direction from their narrower lower ends. The use of such frustoconical inner and outer elements, unlike the case of elements of constant cross-section such as shown in FIGS. 1–3, enables the adjustment of the intake duct aperture defined between the two concentric shells or elements simply by axial movements of one of the shells relative to the other. This provides a simple means for controlling the draft or flow of intake air through the intake flue 45 into the combustion zone 47. One convenient arrangement for adjusting the height of the inner shell 46 relative to the outer shell 42 is shown in FIG. 5 and comprises cut-out areas made in the upper rim 49 of the outer shell 42 to make a stepped edge 50 at four equally spaced locations along upper rim 49 of outer shell 42. The inner shell 46 is supported on the upper rim 49 of the outer shell 42 by means of handles 51 projecting from side wall 53 of inner shell 46. Four handles 51 provide stable support and also convenient means for lifting inner shell 46 to move handles 51 to engage respective steps along the edge 50. The same relative step is engaged simultaneously by each handle 51 in a corresponding cut-out in the rim 49 of inner shell 46 so as to stably support the inner shell at a selected height relative to the outer shell 42. The height of the inner shell is readily adjusted by lifting it momentarily and rotating the shell 46 to bring the handles 51 into alignment with the desired height steps along the edge 50, at which point the shell 46 is lowered, allowing handles 51 to engage their respective steps to support inner shell 46. A container 52 is supported by any convenient means to extend partially into the upper opening of the inner shell 46 to define an annular exhaust flue 54 between the container 52 and inner shell 46. Advantageously, the container 52 may also be frustoconical such that the aperture of the exhaust flue 54 may also be adjusted to control the rate of flow of the hot exhaust gases to the atmosphere simply by raising or lowering the container 52 in relation to the inner shell 46 by any convenient means. The adjustment of the exhaust flow is advantageous in that it is desirable to promote maximum heat transfer to both content of the pot 52 as well as to the inner shell 46 to preheat the intake air to the maximum extent possible.

FIG. 6 is a top plan view of the arrangement similar to that of FIG. 5 except that container 52 has been removed for clarity. The arrangement of stepped cut-out 50 is better appreciated in FIG. 6, one such cut-out being provided on each of the four locations 50 on the rim 49 of outer shell 42.

Figure 7:
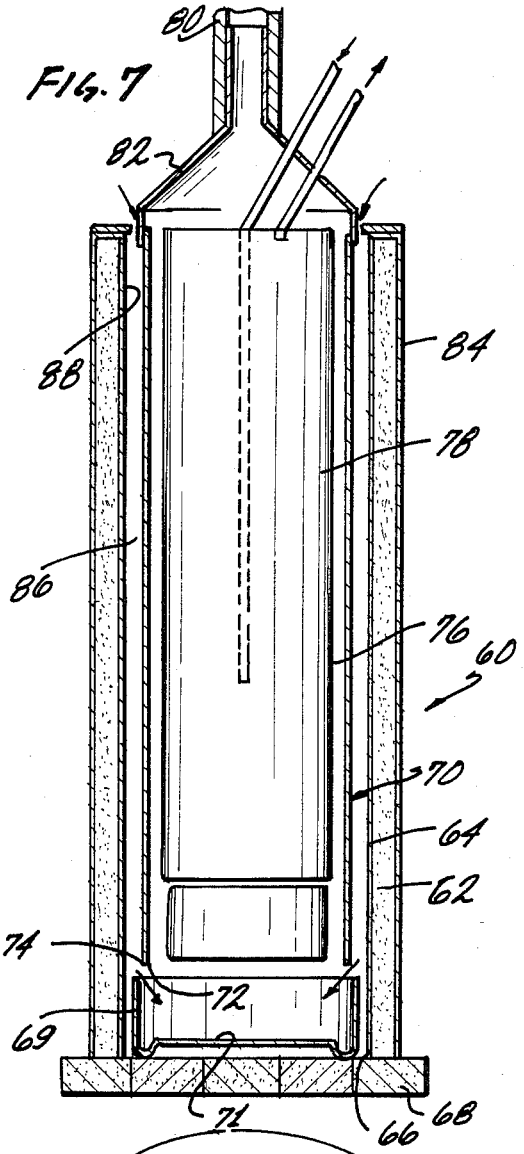
FIG. 7 is a side elevation view, partially in section, of a water heater constructed according to the invention.

FIG. 7 shows a water heater suitable for household use and constructed according to the principles of the present invention for taking advantage of locally available fuel such as wood, coal etc. for fueling the heater 60. The heater comprises an outer shell element 62 having a shell wall 64 and a bottom rim 66 set on a thermally insulating, fire proof foundation 68. An inner shell 70 of smaller cross-sectional dimension i.e. of smaller diameter than the outer shell 62, is supported with its lower end 72 in elevated relationship with the bottom 66 of the outer shell 62, so as to define an air intake annular or otherwise shaped opening 74 between the inner and outer shell. Positioned within the lower portion of outer shell 62 is a fire box 69 where fuel is placed on the bottom 71 and ignited. The hot combustion products rise within the inner shell 70, through an exhaust space or flue 76 defined between the inner shell 70 and a water tank 78 supported within the inner shell 70. The contents of the tank 78 are heated by thermal transfer from the rising hot gases which are then discharged through a chimney 80 fitted to the upper end of the inner shell 70. The aperture of the chimney 80 is desirably restricted by means of a conical upper portion 82 and preferably fitted with a damper as commonly used in wood stove chimneys so as to contain hot gases within the shell 70 and obtain maximum heat transfer therefrom to the tank 78 prior to discharge of the gases through the chimney. The water tank 78 is fully container within the inner shell 70 to derive maximum benefit from the heater. The thermal efficiency of the arrangement is further improved by provision of a thermally insulating enclosure shell 84 surrounding both inner and outer shells 62, 70, and defining an intake passage 86 with the inner shell 70 which is of reduced cross-section relative also to the insulating shell 84. The insulating shell 84 minimizes loss by conduction and by radiation from the inner shell 70 as well as the tank 78. The insulating shell 84 may be formed as a hollow shell filled with a suitable insulating material. The inner face 88 of the insulating outer shell 84 defines an annular air intake flue or passage 86 extending substantially the full length or height of the inner shell 70 such that intake air is preheated by thermal transfer along the entire height of the inner shell prior to entry into the fire box 62.

Figure 8:
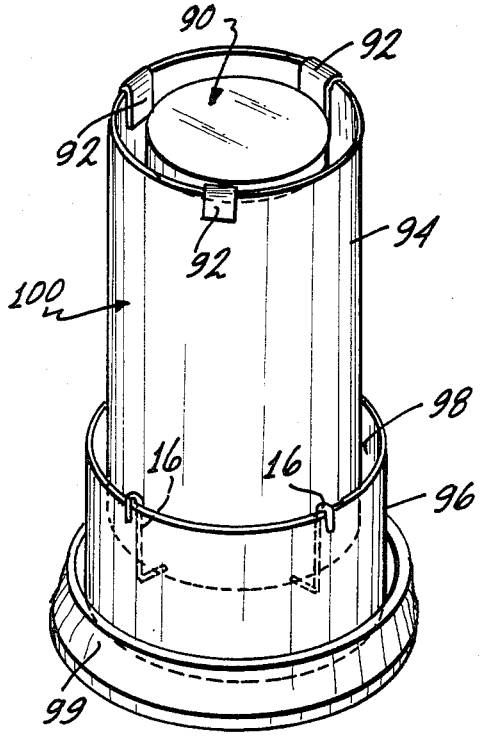
FIG. 8 is an isometric view, taken from above, of a furnace constructed according to the invention and designed specifically for space heating by radiation.

FIG. 8 illustrates a stove arrangement constructed according to the principles of the present invention and specifically designed for space heating by radiation. Restrictor element 90 is suspended by means of rim hangers 92 within the upper end of inner shell 94 of a stove unit 100 which otherwise conforms to the systems described earlier and comprises an outer shell 96 surrounding the inner shell 94 and defining therewith an air intake annular passage 98, and a bottom pan 99 which supports and closes the lower end of the outer shell 96. The inner shell 94 is hung by means of hangers 16 from the rim of the outer shell 96. Restrictor element 90 is of diameter relative to the diameter of inner shell 94 so as to form a restricted annular opening for exhaust gases thereby to prevent random flow of air into inner shell 94.

Figure 9:
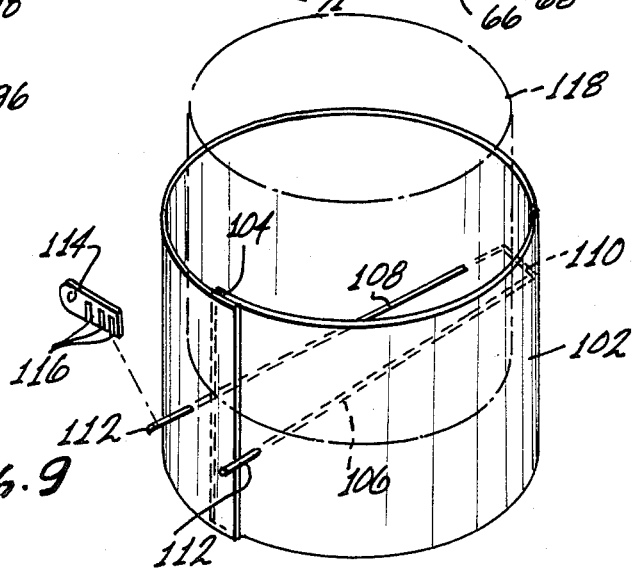
FIG. 9 is an isometric view, taken from above, of a shell constructed so as to permit controlled variation in effective diameter for use in certain embodiments of the invention for purposes of draft control.

FIG. 9 illustrates one possible arrangement for varying the effective diameter of an outer shell in a stove according to the present invention. By thus varying the diameter of the outer shell relative to the diameter of the inner shell, the annular space therebetween comprising the air intake passage can be varied in cross-sectional area for purposes of draft control. A flexible sheet of, e.g., sheet metal is rolled into a cylinder 102 having overlapping edges 104. The diameter of the cylinder 102 may be varied by increasing or decreasing the degree of overlap of the edges 104. A U-shaped element 106 having two straight prongs 108 joined at a closed end 110 and having free ends 112 is inserted through openings in the shell 102 such that the two prongs 108 extend generally diametrically through the shell, but each free end 112 of a corresponding prong 108 extends through an opening near opposite overlapping edges 104. The diameter of the rolled up sheet 102 can be then varied by adjusting the spacing between the free ends 112. The edges 104 of the sheet 102 can be overlapped to a greater extent by bringing the ends 112 closer together, while the reverse affect is obtained by spreading apart the free ends 112. The sheet 102 is retained at a desired diameter by means of a latch element 114 which is pivotably supported on one free end 112 and has a series of spaced apart grooves 116 adapted to capture the other free end 112 at a selected distance from the first end 112. The effective diameter of the outer shell 102 can thus be easily adjusted by releasing the latch 114 and reinserting the free end 112 by in any one of the grooves 116. The U-shaped element 106 thus comprises a draft control element and is further useful as a support for the cylindrical inner shell 118 shown in dotted lining in FIG. 9, thus eliminating the need for wire hangers 16 such as used in previously described embodiments. The generally parallel rods or bars 108 of U-shaped element 106 provide a stable support for the lower rim of the inner shell 118.

Figure 10:
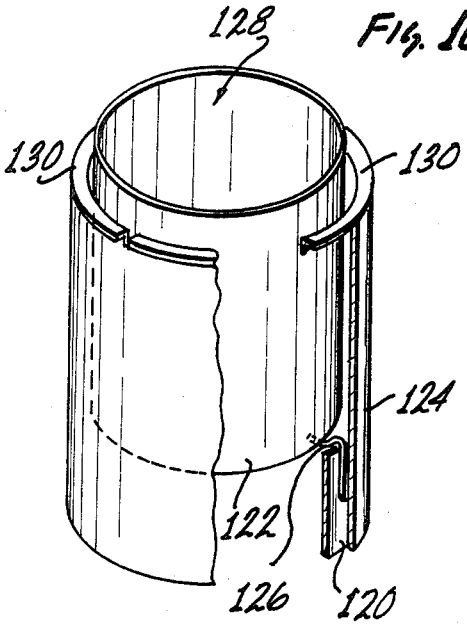
FIG. 10 is an isometric view, taken from above, of an embodiment of the invention showing, by means of partial cutaway, a heat shield or refractory liner at the base portion to protect an outer shell; and showing one form of draft control means resting on the upper edge of the outer shell.

FIG. 10 shows an alternate stove configuration wherein a fire containment shell 120 is provided intermediate the inner shell 122 and outer shell 124. The lower rim of the inner shell 122 is supported on wire formed hangers 126 supported along the upper rim of the fire containment shell 120. Each of the three shells is cylindrical, the diameter of the containment shell 120 being intermediate the diameters of the inner shell 122 and outer shell 124. An air intake flue is defined between the inner and outer shell 122, 124 respectively, while a second, inner air intake 126 is defined between the inner shell 122 and containment shell 120. A pot or container may be suspended or otherwise supported partially or fully inserted into the upper opening 128 of the inner shell 122 by any suitable means. Intake air draft control may be achieved by providing two semicircular control rings 130 independently slideable along the upper rim of the outer shell 124. The control rings 130 partially or fully cover the gap between the inner and outer shell. If one ring is slid into overlapping relation with the other ring 130, the air intake opening between the inner and outer shells is partially uncovered to an extent depending on the degree of overlapping between the two control rings to thereby regulate the flow of intake air into the space between the inner and outer shells.

Figure 11:
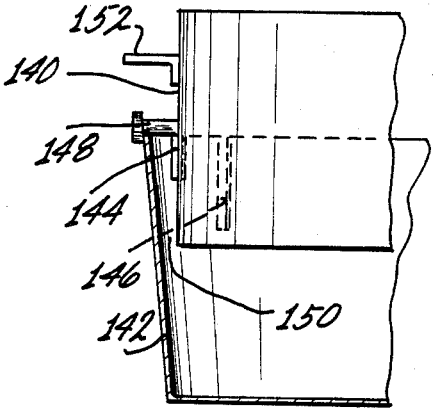
FIG. 11 is a partially cutaway side view of an embodiment of the invention incorporating alternate draft control means.

FIG. 11 illustrates an arrangement whereby draft control is achieved by varying the height of an inner shell 140 in relation to a frustoconical outer shell 142. Vertical grooves 144 and 146 of varying depth are cut into the upper rim of the outer shell 142. The inner shell 140 is provided with a radially extending pin support 148 which may rest either directly on the upper rim of the outer shell 142 or be lowered into one of the notches 144, 146 to support the inner shell 140 at varying height relative to the outer shell 142, thereby varying the axial separation between the two shells and changing the aperture of the air intake flue 150 as a result. It would be understood that more than one pin 148 is required to stably support the inner shell 140 and that such additional pins and corresponding grooves 144, 146 are provided at suitably circumferentially spaced locations of the upper rim of outer shell 142. For convenience, the inner shell 140 may be provided with a thermally insulating handle 152 which allows the draft control adjustment to be made even while the inner shell is hot.

Figure 12:
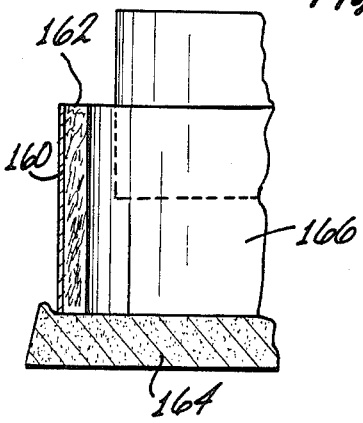
FIG. 12 is a partially cutaway side view of an embodiment of the invention incorporating insulating means around and underneath the combustion chamber.

FIG. 12 shows a still further embodiment of the invention wherein the outer shell 160 includes an insulating lining or layer 162, and the bottom pan 164 is made of thermally insulating material so as to better contain heat within the combustion zone 166 and maintain a higher combustion temperature in the stove.

Figure 13:
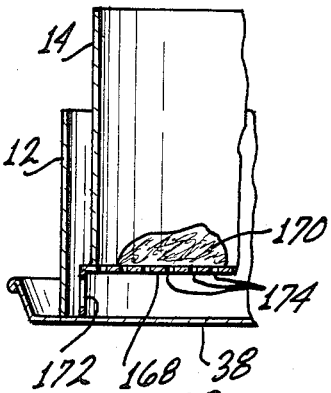
FIG. 13 is a partially cutaway sectional view of an embodiment of the invention similar to that shown in FIG. 3 to which has been added a grate for support of a fuel charge.

FIG. 13 illustrates an embodiment similar to that of FIG. 3 but to which has been added a fuel supporting grate 168 which supports a fuel charge 170 in spaced relationship to the bottom pan 38 so as to allow intake air to flow through side openings 172 in the grate and reach the underside of the fuel charge 170 through grate perforations 174 for more uniform and improved combustion of the fuel charge 170. Desirably, the height of the grate is such as to support the fuel charge 170 above the lower rim of the inner shell 14. The upper surface of the fuel grate 168 may in fact serve as a support on which rests the inner shell 14 as well as the fuel charge 170.

Figure 14:
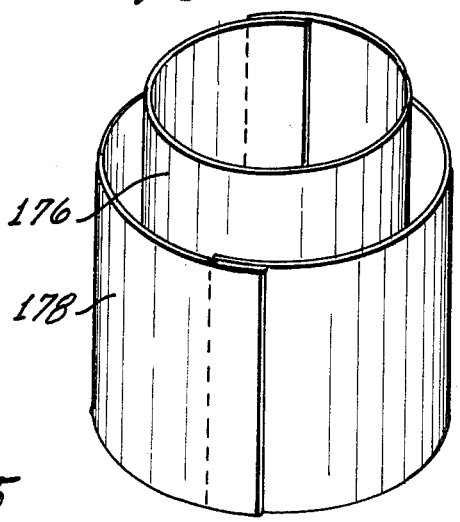
FIG. 14 is an isometric view, taken from above, of two shells in spaced relation to each other and constructed according to the invention for varying the relative diameters of each.
Figure 15:
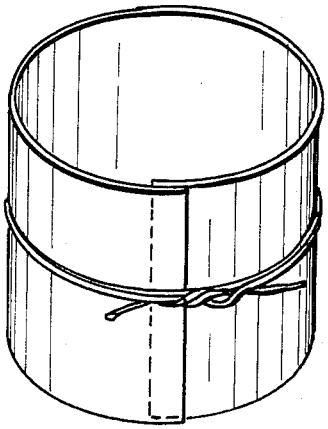
FIG. 15 is an isometric view, taken from above, of a shell constructed according to the invention and restrained from expanding by means of a wire rope.

FIG. 14 shows an embodiment of the invention wherein both an inner shell 176 and an outer shell 178 concentric therewith are made of rolled sheet metal to define two cylinders of variable diameter. Thus, the diameter of the inner shell may be adjusted to suit a particular cooking container supported within its upper end, thus to provide an optimum exhaust flue opening, while the diameter of the outer shell 178 may be adjusted to provide an optimum intake air aperture for the so adjusted inner shell diameter. The roller sheets constituting the inner and outer shell in FIG. 14 may be retained at a particular diameter by means of a cable such as a metallic wire or equivalent means wrapped around its cylindrical surface as shown in FIG. 15 and tied to prevent unrolling of the cylinder.

Figure 16:
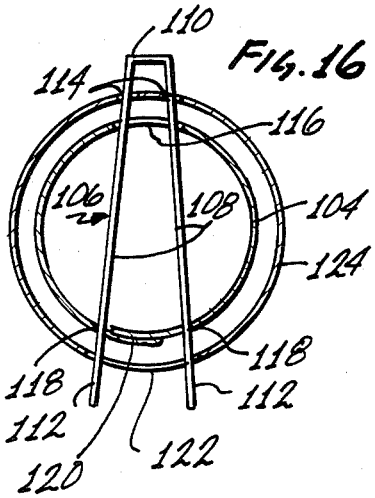
FIG. 16 is a plan view, partially in section, of a structure similar to that depicted in FIG. 14 but incorporating wireform means for varying effective diameter of the inner shell only.

FIG. 16 shows an alternate retainer for a stove wherein the inner shell 104 is a rolled sheet such as in FIG. 14 but the outer shell 124 is a fixed cylindrical structure. The retainer consists of a tweezer-like, U or V-shaped retainer 106 similar to that of FIG. 9 and comprising two legs 108 joined at one closed end 110 and having free ends 112 at their opposite ends. The closed end 110 is fixed by the legs 112 passing through restricted openings 114 in the outer shell 104, and a circumferential slot 116 in the inner shell 104. The free ends 112 then extend through restricted openings 118 each of which is near an opposite overlapping edge 120 of the rolled up inner shell 104. Finally, the free ends 112 extend through a circumferential slot 122 in the outer shell 124. The diameter of the inner shell is thus variable by squeezing free ends 112 closer together or spreading them apart within the circumferential slot 112, to increase or decrease respectively the extent of overlap of the edges 120 of the inner shell 104. As in FIG. 9, the retainer 106 may be provided with a suitable latch element to hold together the free ends 112 at any suitable mutual spacing so as to fix the diameter of the inner shell 104 at a desired aperture. The retainer element 106 also is also useful in supporting the inner shell within the outer shell thereby eliminating the wire hook 16 used in previously described embodiments.

FIG. 17 shows an alternate form of the invention in which both inner and outer shells are square in planform as depicted in FIG. 18, which shows the embodiment of FIG. 17 in plan view. This form lends itself to use with a pan 190 such as the well-known Chinese wok, a shallow dish-like utensil of spherical form which when resting on the upper edges 192 of inner shell 194 provides outlets for escape of gases in the four corner areas 196 of inner shell 194 under pan 190. Shown in this embodiment is a grate 198 in the form of a wire mesh or perforated metal panel resting on screws 200 affixed through walls 202 of outer shell 204. Inner shell 194 then rests on panel 198. Functioning of this embodiment of the invention is similar to that of the embodiment shown in FIG. 13.

While a number of embodiments of the present invention have been described and illustrated for purposes of explanation and clarity, many still further changes modifications and substitutions will become apparent to those possessed of ordinary skill in the art without departing from the spirit and scope of the present invention which is defined only by the following claims.

What is claimed is:

1. A high-efficiency stove comprising:

an outer tubular shell surrounding an inner tubular shell of heat conductive material, each said shell having an upper rim and a lower rim, said shells defining therebetween an air intake flue open between said upper rims for admitting atmospheric air, means for closing the lower end of said outer shell to define a combustion zone above said means for closing, said combustion zone being in communication with said intake flue, and container means supported at least partly within said inner shell and defining therewith an annular exhaust flue for hot combustion gases rising from said combustion zone, said inner shell forming a wall common to both said intake and exhaust flues such that intake air drawn downwardly into said intake flue is preheated by transfer of heat through said inner shell from hot gases escaping through said exhaust flue for improved combustion of fuel in said combustion zone; and variable draft control means for adjustably controlling the flow of intake air reaching said combustion zone through said intake flue.

2. The stove of claim 1 further comprising fuel supporting means for supporting a charge of fuel in said combustion zone above said means for closing so as to allow intake air flow into the underside of a fuel charge supported thereon.

3. The stove of claim 1 wherein said means for closing is a ground surface supporting said outer shell.

4. The stove of claim 1 wherein at least one of said shells is made of sheet metal.

5. The stove of claim 1 wherein said inner shell is supported with its lower rim elevated in relation to the lower rim of said outer shell thus defining an annular aperture from said intake flue into said combustion zone.

6. The stove of claim 1 wherein said inner shell is apertured near its lower rim to admit intake air from said intake flue into said combustion zone.

7. The stove of claim 2 wherein said draft control means is provided by varying the cross section of one of said shells relative to the cross-section of the other of said shells, thereby varying the cross-section of said intake flue defined therebetween.

8. The stove of claim 1 wherein said draft control means comprise intake cover means slideable for varying the intake opening of said intake flue.

9. The stove of claim 1 wherein at least one of said shells is frustoconical whereby the aperture of said intake flue is variable by axial movement of one of said shells relative to the other of said shells to thereby control the draft of intake air.

10. The stove of claim 9 wherein said inner shell is frustoconical whereby said container means may be supported at varying heights relative to said inner shell such that the aperture of said exhaust flue is variable by axialy raising or lowering said container means in relation to said inner shell.

11. The stove of claim 1 wherein at least one of said inner and outer shells is made of a metal sheet rolled to form a cylinder of variable diameter and further comprising retainer means for releasably holding said rolled sheet at any selected one of a plurality of shell diameters so as to permit adjustment of the flow of intake air by varying the relative cross section of said two shells.

12. The stove of claim 11 wherein said retainer means is a wire wrapped around said shell and fixed to hold it at a particular diameter against unrolling.

13. A high-efficiency stove comprising inner and outer generally concentric tubular elements each having an upper end and a lower rim and defining therebetween an intake air passage, said inner element being of heat conductive material and supported through intermediate means by said outer element with its lower rim elevated in relation to the lower rim of said outer element so as to define with an underlying supporting surface such as a ground surface an annular opening between said outer tubular element and the lower end of said inner tubular element, such that fuel burned on said underlying surface for heating the contents of a container supported within said inner element causes hot gases to rise through and heat said inner element, drawing intake air downwardly through said intake air passage, said intake air being preheated before reaching the burning fuel by contact with said inner element; and adjustable draft control means for variably manually controlling the volume of intake air flowing through said intake air passage.

14. The stove of claim 13 wherein said underlying surface is provided by bottom pan means.

15. The stove of claim 14 wherein said bottom pan means is affixed to said lower rim of said outer element.

16. The stove of claim 13 further comprising fuel grate means for supporting a fuel charge above said lower rim of and within said inner element.

17. The stove of claim 13 further comprising container means supported within said inner element and defining therewith a restricted exhaust flue so as to bring hot exhaust gases into contact with said inner element for transferring exhaust heat to intake air through said inner element.

* * * * *